US010668354B2

(12) United States Patent
Kern

(10) Patent No.: US 10,668,354 B2
(45) Date of Patent: Jun. 2, 2020

(54) PLAY DEVICE FOR A REBOUND SPORT

(71) Applicant: FUN WITH BALLS GmbH, Munich (DE)

(72) Inventor: Markos Aristides Kern, Munich (DE)

(73) Assignee: FUN WITH BALLS GMBH, Munich (DE)

( * ) Notice: Subject to any disclaimer, the term of this patent is extended or adjusted under 35 U.S.C. 154(b) by 0 days.

(21) Appl. No.: 15/973,313

(22) Filed: May 7, 2018

(65) Prior Publication Data

US 2018/0250576 A1 Sep. 6, 2018

Related U.S. Application Data

(63) Continuation of application No. PCT/EP2017/064400, filed on Jun. 13, 2017.

(30) Foreign Application Priority Data

Jun. 13, 2016 (DE) ..... 10 2016 110 818

(51) Int. Cl.
*A63B 71/06* (2006.01)
*A63B 63/00* (2006.01)
(Continued)

(52) U.S. Cl.
CPC ..... *A63B 71/0622* (2013.01); *A63B 24/0059* (2013.01); *A63B 24/0075* (2013.01);
(Continued)

(58) Field of Classification Search
CPC ..... A63B 71/0622; A63B 71/0669; A63B 24/0059; A63B 24/0075; A63B 63/00; A63B 69/0097; A63C 19/02
(Continued)

(56) References Cited

U.S. PATENT DOCUMENTS 4,309,032 A * 1/1982 Facius ..... A63B 69/0097 273/376
4,915,384 A * 4/1990 Bear ..... A63B 24/0021 273/454
(Continued)

FOREIGN PATENT DOCUMENTS

DE 20301160 U1 7/2003
DE 102008012520 A1 9/2009
(Continued)

OTHER PUBLICATIONS

International Search Report of the European Patent Office in PCT/EP2017/064400 (from which this application claims priority) dated Sep. 22, 2017 and English-language translation thereof.
(Continued)

*Primary Examiner* — Allen Chan
(74) *Attorney, Agent, or Firm* — Falk Ewers; Ewers IP Law PLLC

(57) ABSTRACT

A play device for a rebound sport with a play area is provided, on which a ball can be played by a player to rebound from an impact position in accordance with a predetermined set of rules of the rebound sport, which includes a sensor system configured to detect two-dimensional first coordinates of the impact position and to transfer the two-dimensional first coordinates to a computing unit configured to determine two-dimensional second coordinates, a size and/or a shape of a target field depending on the first coordinates in accordance with a predetermined specification and to control a projector to project the target field to be optically perceptible by the player on a projection area, wherein the ball can be played by the player on the target field to rebound from the target field in accordance with the set of rules of the rebound sport.

14 Claims, 3 Drawing Sheets

(51) Int. Cl.

| | |
|---|---|
| ***A63B 69/00*** | (2006.01) |
| ***A63B 24/00*** | (2006.01) |
| ***A63C 19/02*** | (2006.01) |
| *A63B 102/06* | (2015.01) |
| *A63C 19/06* | (2006.01) |

(52) U.S. Cl.
CPC ..... *A63B 63/00* (2013.01); *A63B 69/0097* (2013.01); *A63B 71/0669* (2013.01); *A63C 19/02* (2013.01); *A63B 2024/004* (2013.01); *A63B 2024/0037* (2013.01); *A63B 2024/0056* (2013.01); *A63B 2071/0658* (2013.01); *A63B 2071/0694* (2013.01); *A63B 2102/06* (2015.10); *A63B 2207/02* (2013.01); *A63B 2220/805* (2013.01); *A63B 2220/806* (2013.01); *A63B 2225/50* (2013.01); *A63C 2019/067* (2013.01); *A63C 2203/12* (2013.01); *A63C 2203/14* (2013.01); *A63C 2203/18* (2013.01)

(58) Field of Classification Search
USPC ..... 473/415
See application file for complete search history.

(56) References Cited

U.S. PATENT DOCUMENTS 6,135,456 A * 10/2000 Cooper ..... A63B 63/00 273/348
2010/0198528 A1* 8/2010 McCauley ..... A63B 24/0021 702/41

FOREIGN PATENT DOCUMENTS

| | | | |
|---|---|---|---|
| FR | 3031459 | A1 | 7/2016 |
| GB | 2293772 | A | 4/1996 |
| JP | 2011172891 | A | 9/2011 |
| WO | 8706848 | A2 | 11/1987 |

OTHER PUBLICATIONS

Office Action issued in German Patent Application No. DE 10 2016 110 818.9 (from which this application claims priority), dated May 12, 2017 and English language translation thereof.
International Preliminary Report on Patentability of the European Patent Office in PCT/EP2017/064400 (from which this application claims priority) dated Sep. 22, 2017 and English-language translation thereof.
Office Action issued in China Counterpart Patent Application No. 201780004065.5, dated Jan. 17, 2020 and English language translation thereof.
Office Action issued in European Counterpart Patent Application No. EP 17 733 998.3, dated Nov. 20, 2019, and English language machine translation thereof.

* cited by examiner

PLAY DEVICE FOR A REBOUND SPORT

CROSS REFERENCE TO RELATED APPLICATIONS

This application is a continuation application of international patent application PCT/EP2017/064400, filed Jun. 13, 2017, designating the United States and claiming priority to German patent application No. 10 2016 110 818.9, filed Jun. 13, 2016, and the entire content of both applications is incorporated herein by reference.

TECHNICAL FIELD

The invention relates to a play device for a rebound sport, a squash court and a method for playing the rebound sport.

BACKGROUND

A rebound sport is a ball sport in which two players or teams pass to each other a ball via a wall following a predetermined set of rules and trying to force the opponent to make mistakes during receiving or returning the ball. Mistakes of a party lead to points for the other party and/or give the other party the right to serve. Squash is a rebound sport. It is also understood as a rebound sport when a single player is passing himself a ball via a wall. The wall can be a plane or a curved area or an edge. It is understood that the ball can be any means that can be played on the wall for rebounding therefrom.

The rebound sport is in particular attractive, when it is played fast, varying and with wit. For this purpose, it is required that the players have a high level of fitness, in particular a long endurance and a high velocity. Play routine for a player can generally be reached by frequent practicing and a versatile play praxis, which requires a long mental endurance and an according love of the player for the rebound sport. It is hereby problematic that less motivated players practice reluctantly or even cancel an advised practice program prematurely.

In the mass sport as well as in the professional sport, a coach can be engaged for supporting the player. The coach motivates a player and supports him with the development of his play level. However, the coach is limited with his possibilities, wherein the coach cannot prevent the monotony arising at the player during playing or practicing the rebound sport.

SUMMARY

It is an object of the invention to provide a play device for a rebound sport and a method for playing the rebound sport, wherein the player has fun during playing the rebound sport and a player is effectively trained.

The object is achieved by the play device and the method for playing the rebound sport as disclosed herein.

The play device according to an aspect of the invention for a rebound sport includes a play area, on which a ball can be played by a player for rebounding from an impact position of the play area in accordance with a predetermined set of rules of the rebound sport and which includes a sensor system that is configured to detect two-dimensional first coordinates of the impact position and to transfer the two-dimensional first coordinates to a computing unit of the play device, wherein the computing unit is configured to determine two-dimensional second coordinates, a size and/or a shape of at least one target field in dependence of the first coordinates in accordance with a predetermined specification and to control a projector of the play device with which the target field can be projected optically perceptible for the player on a projection area arranged within the play area, wherein the ball can be played by the player on the target field for rebounding from the target field in accordance with the set of rules of the rebound sport. The squash court according to an aspect of the invention includes the play device.

The method according to an aspect of the invention for playing the rebound sport includes the steps of playing a ball by a player on a play area for rebounding from an impact position of the play area in accordance with a predetermined set of rules of the rebound sport, detecting of two-dimensional first coordinates of the impact position, determining two-dimensional second coordinates, a size and/or a shape of at least one target field in dependence of the first coordinates in accordance with a predetermined specification, projecting the target field on a projection area arranged within the play area, wherein the target field is optically perceived by the player, and subsequently playing the ball by the player for rebounding from the target field in accordance with the set of rules of the rebound sport. The method typically includes the step of providing the play device.

In accordance with the set of rules, the play area is an integral part of the rebound sport. As a result of the ball being played by the player on the play area and the target field being projected optically perceptible for the player on the play area, the play area serves as a sport device as well as a projection area. By the target field, the player is indicated where he has to play the ball next. The position of the target field is determined by using the location of the impact position and the predetermined specification by taking into account this location on the play area. It is therefore possible to require a varying and fast play from the player by a corresponding two-dimensional position shift between the impact position and the target field on the play area. If for example the target field remains at the same position of the impact position, the reproducibility of the play is trained.

In addition to the position of the target field on the play area, the form and/or the shape of the target field can also be determined in accordance with the predetermined specification. The smaller, for example, the target field is formed, the higher are the requirements for the player with respect to his precision. For example, the size of the target field can be varied such that during the game the target fields are formed increasingly smaller, whereby the player is required to increase his precision during the game. To form the shape of the target field, aesthetic as well as tactical considerations with respect to the rebound sport can play a role. If, for example, the player is still a child, it could be attractive for the player when the target field has for example a heart shape or a similar shape. Further, the shape of the target field can be chosen such that, when the ball impacts in the target field, the reachability of the ball can be decreased for an opponent.

By projecting the target field on the play area depending on the location of the impact position, the game of the player is guided with a focus, whereby an intervention in the game of the player from outside of the game is enabled via the predetermined specification. In accordance with the location of the impact position, the player is given an orientation with respect to the next play action on the ball by arranging the target field on the play area, wherein the ball is supposed to hit the target field.

According to an aspect of the invention, multiple target areas are simultaneously projected on the play area to give the player alternative targets for his subsequent play action. By the predetermined specification, the play of the player can be imprinted an according choreography, whereby the player has to perform tactical sequences with fast reactions. Further, the level of the player, the form of the day and the aim of the game, for example if a hard training is to be performed or if the game is supposed to be played with ease and fun, can be taken into consideration by the choice of the predetermined specification. A reasonable and attractive placing of the target field or the target fields can be obtained by the choice of the predetermined specification, whereby an according type and character of the rebound sport can be imprinted. Without the play device according to an aspect of the invention and the method according to an aspect of the invention, the imprinted type and character would include the set of rules of the rebound sport, but the type and character generally arise during play moves that are accidentally happening. With the play device according to an aspect of the invention and the method according to an aspect of the invention, the game of the rebound sport can be predetermined higher as it would be the case if the play area would be played by the player without the target field or the target fields. It is thereby possible to imprint desired play moves on the game by the play device according to an aspect of the invention and the method according to an aspect of the invention, whereby the player is trained effectively and/or has fun during playing.

The predetermined set of rules is a universally known set of rules for the rebound sport or a newly defined set of rules for the actual game.

Typically, the sensor system is a light barrier, in particular a light grid, for each one of the two-dimensional first coordinates. The light barriers are typically arranged on the rims of the play area, wherein the one of the light barriers is provided for a first coordinate, in particular the horizontal coordinate, and the second of the light barriers is provided for the other of the first coordinates, in particular the vertical coordinate. A field is thereby spanned on the play area by the light barriers, so that each position on the play area, on which the impact position can be located, can be detected by the sensor system. The light barriers typically respectively include a sender and a receiver which are arranged on the play area respectively opposite to one another, wherein light can be irradiated by the sender in direction to the receiver for being received there. When the ball impacts on the impact position, the corresponding light path from the sender to the receiver is interrupted by the ball, whereby the corresponding coordinates of the impact position can be detected. The senders emit typically pulsed light, whereby energy is saved in comparison with the emission of continuous light. The pulse durations of the pulsed light are to be chosen such that despite the comparably small residence time of the ball on the impact position the presence of the ball can be detected.

The sensor system may include a light barrier, in particular a light grid, for one of the two-dimensional first coordinates. For capturing the play area, the sensor system may include a camera with an image processing unit, wherein the other of the two-dimensional first coordinates can be detected by the image processing unit. The one of the first coordinates, for example the vertical coordinate, can be detected by the light barrier. The camera continuously records the play area with a corresponding high repetition rate during the game, wherein the ball is advantageously differentiated from the play area with a high contrast. The recordings of the camera show when the ball is played, the flight of the ball in direction to the play area, the impact of the ball on the impact position, and the rebounding of the ball from the impact position. The image processing unit of the camera is configured such that the impact position of the play area can be detected in real-time by using the recordings of the camera, so that the other of the two-dimensional first coordinates, in particular the horizontal coordinate, can be derived. For determining the other of the two-dimensional first coordinates by the image processing unit in particular the velocity and the direction of the ball before and after the impact on the impact position and/or during impact on the impact position is used.

The play device typically includes a server, with which the predetermined specification can be input in the computing unit and/or can be manipulated in the computing unit. Further, the play device typically includes a client-computing unit, with which the predetermined specification can be input remotely in the computing unit and/or can be manipulated in the computing unit, in particular via the server. It is therefore possible to form the predetermined specification preferably with many variations in the computing unit in particular by a remote access. It is possible to store the predetermined specification as a software in an application that can be controlled via the internet or via other remote access technologies. It is therefore possible that numerous specifications are stored as software for example in a database, wherein the specifications can be retrieved on-site from this database for a specific usage of the play device.

The sensor system is typically configured to detect an impact of the ball in the at least one target field and coupled to the computing unit for reporting back the detection to the computing unit. Moreover, the computing unit is typically configured to evaluate the reporting back and to control the projector such that evaluation information is projected as an evaluation display on the projection area. An information is thereby advantageously communicated to the player about the success of his play, for example with which success rate the player hits the target fields given to him. Moreover, the evaluation information is received by the client-computing unit via the server and to thereby provides a control of the player remotely.

It is typical that the rebound sport is squash and the play area includes a front wall and/or a side wall and/or a floor of a squash court. As an alternative, the play area may have an uneven shape, in particular a cylindrical or a half-cylindrical shape. It is moreover conceivable that the play area is formed by an edge, wherein the ball is in particular a sphere. It is conceivable that the rebound sport is billiard.

It is further conceivable that the rebound sport is tennis, wherein the play area is formed as a wall. The wall can be arranged as a replacement to the tennis net. The wall can be arranged additionally or alternatively above the tennis net. The wall can be formed so solid that the ball can rebound on the play area. Alternatively, the wall can be formed penetrable for the ball, wherein a further player standing on the other side of the wall with respect to the one player rebounds the ball.

For reporting back about the quality and/or the quantity of the play to the to the player himself and/or to a client, the method typically includes the steps of projecting the target field on a projection area arranged within the play area, wherein the target field is optically perceived by the player, and subsequently playing the ball by the player for rebounding from the target field according to the set of rules of the rebound sport. The method further includes the steps of detecting an impact of the ball in the at least one target field, evaluating the reporting back and projecting evaluation information as an evaluation display on the projection area.

BRIEF DESCRIPTION OF THE DRAWINGS

The invention will now be described with reference to the drawings wherein.

DESCRIPTION OF EXEMPLARY EMBODIMENTS

Figure 1:
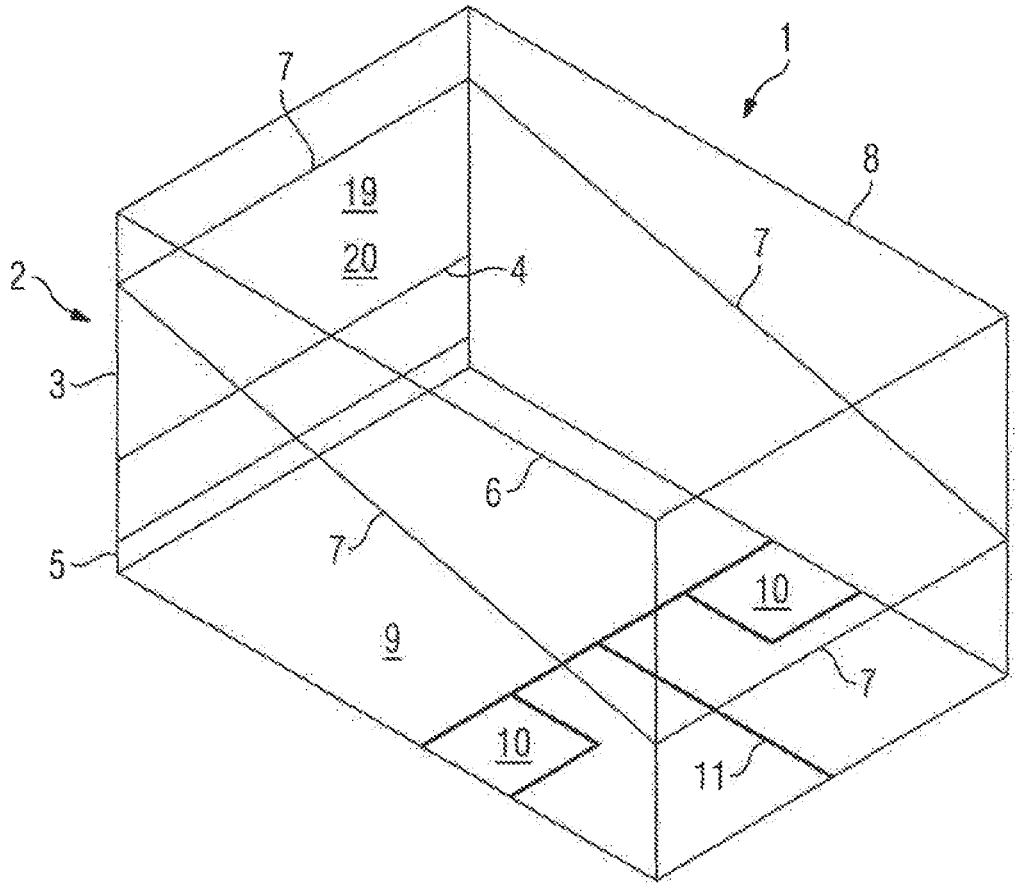
FIG. 1 shows a schematic three-dimensional illustration of a squash court.
Figure 2:
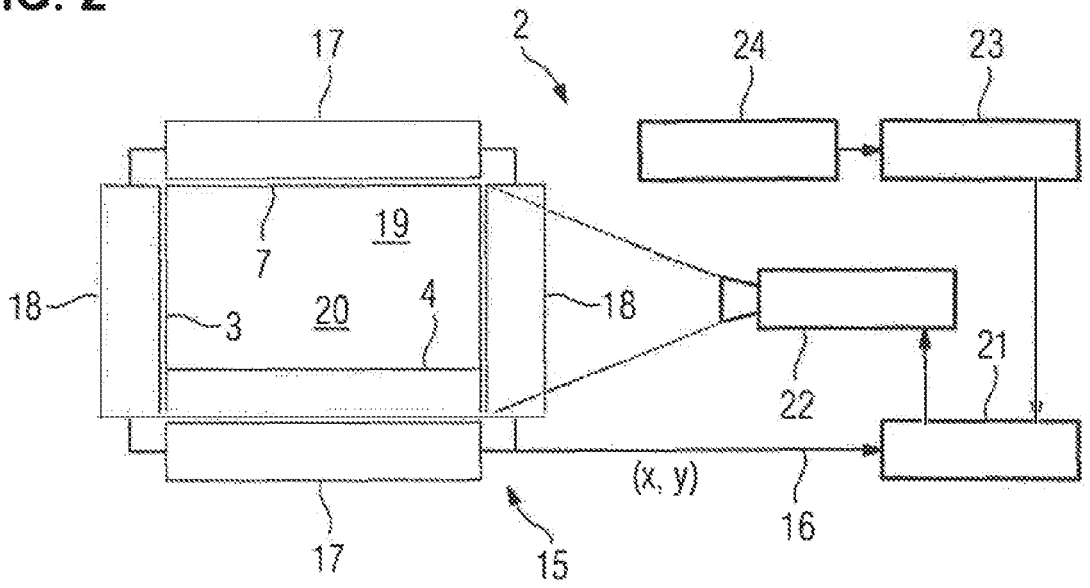
FIG. 2 shows a schematic illustration of a first exemplary embodiment of the play device.

As shown in FIGS. 1 to 4, a squash court 1 includes a play device 2. The play device 2 includes a front wall 3. The front wall 3 includes in a lower third an impact line 4 and on the bottom a tin 5. The squash court 1 is confined on the sides by a left side wall 6 and a right-side wall 8, wherein the front wall 3, the left side wall 6 and the right-side wall 8 are marked by an out line 7. Two serve fields 10 are marked on the floor 9 of the squash court 1, wherein a middle line 11 is arranged between the two serve fields 10.

A player 12 stands in the squash court 1 on the floor 9 according to the set of rules and plays with a racket 13 a ball 14 on the front wall 3, the left side wall 6, the right-side wall 8 and/or the floor 9, wherein the ball 14 is supposed to rebound below the impact line 4. If the player 12 serves, the ball 14 is supposed to impact on the front wall 3 above the impact line 4.

The play device 2 includes a sensor system 15, with which two-dimensional first coordinates 16 (x, y) can be detected. According to a first exemplary embodiment shown in FIG. 2, the sensor system 15 includes a first light grid 17 and a second light grid 18. A play area 19, that is spanned by the front wall 13, is the area, on which the ball 14 is to be played by the player 12 with the racket 13 during the squash game. It is conceivable that the play area 19 also extends on the left-side wall 6 and/or the right-side wall 8 and/or on the floor 9. The first light grid 17 is configured to detect the vertical coordinate y of the play area 19 and the second light grid 18 is configured to detect the horizontal coordinate x of the play area 19. The front wall 3 further has a projection area 20 that coincides with the play area 19. It is also conceivable that the projection area 20 is smaller than the play area 19 but arranged within the play area 19.

The play device 2 includes a computing unit 21 that is coupled with the light grids 17, 18, wherein the light grids 17, 18 transfer data about the two-dimensional first coordinates 16 detected by them. Further, a predetermined specification is stored in the computing unit 21, according to which two-dimensional second coordinates, the sizes and the shapes of target fields 27, 28 are determined in dependence of the two-dimensional first coordinates 16 by the computing unit 21. The play device 2 further includes a projector 22, with which in particular the target fields 27, 28 are projected on the projection area 20. The play device 2 moreover includes a server 23, with which the predetermined specification can be manipulated in the computing unit 21 and input in the computing unit 21. A remote access in the computing unit 21 is enabled by a client-computing unit 24 of the play device 2 via the server 23.

Figure 3:
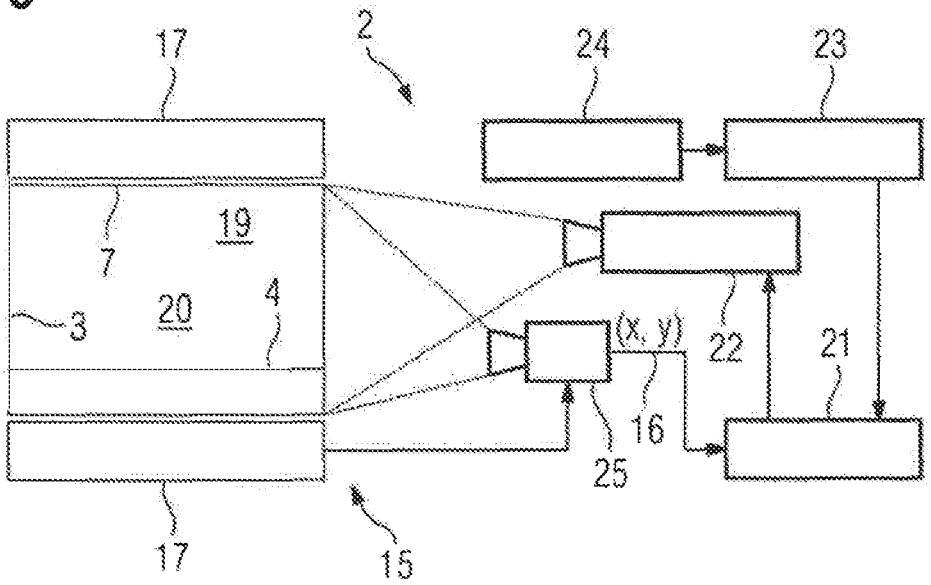
FIG. 3 shows a schematic illustration of a second exemplary embodiment of the play device.
Figure 4:
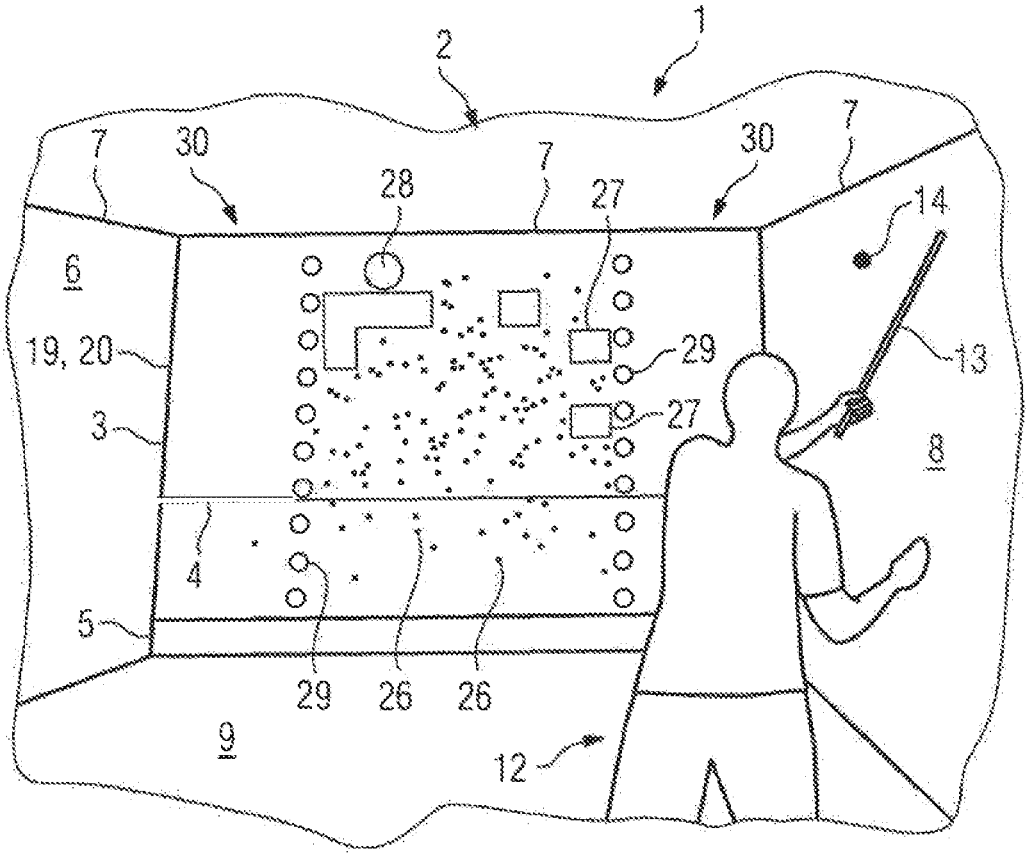
FIG. 4 shows a three-dimensional schematic illustration of a squash court with a glance towards a front wall during the play.

A second exemplary embodiment of the play device 2 is shown in FIG. 3. The second exemplary embodiment includes a camera 25 instead of the light grid 18, wherein the play area 19 is recorded by the camera 25. The camera 25 includes an image processing unit with which the vertical coordinate y can be detected during the impact of the ball 14 on the play area 19.

When squash is played in the squash court 1 with the play device 2, the player 12 stands in front of the front wall 3 and plays the ball 14 on the play area 19 with the racket 13, so that the ball 14 impacts on the play area 19, whereby an impact position 26 is defined within the play area 19. The sensor system 15 according to the first exemplary embodiment is configured with the first light grid 17 and the second light grid 18 and according to the second exemplary embodiment with the first light grid 17 and the camera 25 such that the two-dimensional first coordinates 16 are detected. As a result of the light grids 17, 18 or the light grid 17 and the camera 25 being coupled with the computing unit 21, data according to the detected two-dimensional first coordinates 16 are transferred to the computing unit 21. A dataset with which the target fields 27, 28 are defined are determined by the predetermined specification stored in the computing unit 21 depending on these data. The position on the projection area 20 on which the target fields 27, 28 are supposed to be arranged, and a size and a shape of the target field 27, 28 are determined by the computing unit 21. The first target fields 27 are formed with a quadratic shape, whereas the second field 28 is formed with a round shape. A boundary 29 is defined as a further target field by the computing unit 21, the target fields 27, 28 are arranged within the boundary 29, and the player 12 is supposed to play the ball 14 in the boundary 29.

The game with the play device 2 takes place for example as follows: The player 12 stands in the serve field 10 assigned to him and plays the ball 14 in the direction to the front wall 3, so that the ball 14 impinges on the play area 19. The location at which the ball 14 impinges on the play area 19 is the impact position 26. The sensor system 15 is configured to permit the two-dimensional first coordinates 16 of the impact position 26 to be detected and to be transferred to the computing unit 21. Two-dimensional second coordinates for the target fields 27, 28 as well as the boundary 29 are determined by the predetermined specification stored in the computing unit 21. Further, the number of target fields 27 and the rectangular shape for the target fields 27 are determined by using the predetermined specification. The target fields 27, 28 as well as the boundary 29 are projected by the projector 22, so that this projection is optically perceptible in the projection area 20 by the player 12.

Further, the impact position 26 is marked by a cross and is also projected by the projector 22 on the projection area 20. It is an object for the player 12 to hit in turn with the ball 14 the first target fields 27 that are arranged within the boundary 29.

The sensor system 15 is further configured to detect if the first target fields 27 are hit by the ball 14. The target field 27 being hit by the ball 14 is then blanked out in the projection of the projector 22, so that the remaining first target fields 27, that are not hit, are visible for the player 12 on the projection area 20. If the player 12 succeeds in hitting all first target fields 27 originally displayed on the projection area 20, the second target field 28 is to be hit with the ball 14. If the second target field 28 is also hit, the object of the player 12 in accordance with the predetermined specification stored in the computing unit 21 is solved. All impact positions 26 on the projection area 20 are marked with crosses for the orientation of the player 12.

The two-dimensional second coordinates are evaluated in the computing unit 21 with respect to the hit precision and the number of the impact positions 26. The result hereto is provided to the player 12 for information in form of an evaluation display 30 in the upper region of the projection field 20.

It is understood that the foregoing description is that of the exemplary embodiments of the invention and that various changes and modifications may be made thereto without departing from the spirit and scope of the invention as defined in the appended claims.

LIST OF REFERENCE NUMERALS

1 squash court
2 play device
3 front wall
4 impact line
5 tin
6 left side wall
7 out line
8 right side wall
9 floor
10 serve field
11 middle line
12 player
13 racket
14 ball
15 sensor system
16 coordinates
17 first light grid
18 second light grid
19 play area
20 projection field
21 computing unit
22 projector
23 server
24 client-computing unit
25 camera
26 impact position
27 first target field
28 second target field
29 boundary
30 evaluation display

What is claimed is:

1. A play device for a rebound sport, the play device comprising:

a play area configured to permit a ball to be played by a player to rebound from an impact position of the play area in accordance with a predetermined set of rules of the rebound sport, the ball being played by the player on at least one target field to rebound from the at least one target field in accordance with the predetermined set of rules of the rebound sport;

a computing unit;

a sensor system including a light grid and a camera, being in communication with the computing unit, and being configured to detect two-dimensional first coordinates of the impact position and to transfer the two-dimensional first coordinates to the computing unit, the light grid being configured to detect only a first coordinate of the two-dimensional first coordinates, the camera having an image processing unit and being configured to capture the play area, and the image processing unit being configured to detect only a second coordinate of the two-dimensional first coordinates;

the computing unit being configured to:

determine two-dimensional second coordinates, and at least one of a size and a shape of the at least one target field depending on the two-dimensional first coordinates in accordance with a predetermined specification, and control a projector of the play device configured to project the at least one target field on a projection area arranged within the play area to be optically perceptible by the player.

2. The play device according to claim 1, wherein the sensor system comprises a light barrier for each of the two-dimensional first coordinates.

3. The play device according to claim 1, wherein the sensor system comprises a light grid for each of the two-dimensional first coordinates.

4. The play device according to claim 1, wherein:

the sensor system comprises a light barrier configured to detect one of the two-dimensional first coordinates and a camera having an image processing unit and being configured to capture the play area, and the image processing unit is configured to detect another of the two-dimensional first coordinates.

5. The play device according to claim 1, further comprising a server configured to at least one of:

permit the predetermined specification to be input in the computing unit, and manipulate the predetermined specification in the computing unit.

6. The play device according to claim 1, further comprising a client-computing unit configured to at least one of:

remotely input the predetermined specification in the computing unit, and manipulate the predetermined specification in the computing unit.

7. The play device according to claim 1, wherein the sensor system is configured to:

detect an impact of the ball in the at least one target field, and be coupled to the computing unit to report back a detection of the impact of the ball to the computing unit.

8. The play device according to claim 7, wherein the computing unit is configured to evaluate the detection reported back and to control the projector to project evaluation information as an evaluation display on the projection area.

9. The play device according to claim 1, wherein:

the rebound sport is squash, and the play area includes at least one of a front wall, a side wall, and a floor of a squash court.

10. The play device according to claim 1, wherein:

the camera captures a velocity and a direction of the ball before and after an impact of the ball on the impact position, and the image processing unit detects the second coordinate of the two-dimensional first coordinates based on the velocity and the direction of the ball before and after the impact of the ball on the impact position.

11. A squash court comprising:

a play area configured to permit a ball to be played by a player to rebound from an impact position of the play area in accordance with a predetermined set of rules of a rebound sport, the ball being played by the player on at least one target field to rebound from the at least one target field in accordance with the predetermined set of rules of the rebound sport;

a computing unit;

a sensor system including a light grid and a camera, being in communication with the computing unit, and being configured to detect two-dimensional first coordinates of the impact position and to transfer the two-dimensional first coordinates to the computing unit, the light grid being configured to detect only a first coordinate of the two-dimensional first coordinates, the camera having an image processing unit and being configured to capture the play area, and the image processing unit being configured to detect only a second coordinate of the two-dimensional first coordinates;

the computing unit being configured to:

determine two-dimensional second coordinates, and at least one of a size and a shape of the at least one target field depending on the two-dimensional first coordinates in accordance with a predetermined specification, and control a projector of the play device configured to project the at least one target field on a projection area arranged within the play area to be optically perceptible by the player, wherein the rebound sport is squash, and wherein the play area includes at least one of a front wall, a side wall, and a floor.

12. A method for playing a rebound sport, comprising:

playing a ball by a player on a play area to rebound from an impact position of the play area according to a predetermined set of rules of the rebound sport;

detecting two-dimensional first coordinates of the impact position by a sensor system including a light grid and a camera, the light grid being configured to detect only a first coordinate of the two-dimensional first coordinates, the camera having an image processing unit and being configured to capture the play area, and the image processing unit being configured to detect only a second coordinate of the two-dimensional first coordinates;

determining two-dimensional second coordinates, and at least one of a size and a shape of at least one target field depending on the first coordinates in accordance with a predetermined specification;

projecting the at least one target field on a projection area arranged within the play area, the at least one target field being optically perceived by the player;

subsequently playing the ball by the player to rebound from the at least one target field in accordance with the set of rules of the rebound sport.

13. The method according to claim 12, further comprising:

detecting an impact of the ball in the at least one target field.

14. The method according to claim 12, further comprising:

evaluating a detection reported back, and projecting an evaluation information as an evaluation display on the projection area.

* * * * *